US009498040B2

(12) United States Patent
Rhineberger

(10) Patent No.: US 9,498,040 B2
(45) Date of Patent: Nov. 22, 2016

(54) HAIR DYE APPLICATOR AND METHODS OF USE

(71) Applicant: John Covert Rhineberger, Palm Springs, CA (US)

(72) Inventor: John Covert Rhineberger, Palm Springs, CA (US)

( * ) Notice: Subject to any disclaimer, the term of this patent is extended or adjusted under 35 U.S.C. 154(b) by 0 days.

(21) Appl. No.: 14/517,784

(22) Filed: Oct. 17, 2014

(65) Prior Publication Data

US 2015/0136166 A1 May 21, 2015

Related U.S. Application Data

(60) Provisional application No. 61/905,348, filed on Nov. 18, 2013.

(51) Int. Cl.

| | |
|---|---|
| ***A45D 24/22*** | (2006.01) |
| ***A45D 19/02*** | (2006.01) |
| ***A45D 24/24*** | (2006.01) |
| *A45D 19/00* | (2006.01) |

(52) U.S. Cl.

CPC ..... *A45D 24/22* (2013.01); *A45D 19/02* (2013.01); *A45D 24/24* (2013.01); *A45D 2019/0066* (2013.01); *A45D 2019/0083* (2013.01)

(58) Field of Classification Search

CPC .... A46B 9/023; A46B 11/00; A46B 11/003; A46B 2200/10; A46B 2200/1033; A46B 2200/104; A46B 2200/1093; B05C 1/06; A45D 19/008; A45D 24/22; A45D 40/262; A45D 2019/0066; A45D 2019/0091; A45D 2200/1009; A45D 2200/1018; A45D 24/24; A45D 24/16; A45D 19/02; A45D 2019/0083

USPC ..... 132/108, 109, 110, 150

See application file for complete search history.

(56) References Cited

U.S. PATENT DOCUMENTS

| | | | | |
|---|---|---|---|---|
| 1,286,870 A * | 12/1918 | Betheuser | ..... | A45D 24/22 132/110 |
| 1,487,374 A * | 3/1924 | De Bassini | ..... | A45D 24/24 132/108 |
| 1,823,850 A * | 9/1931 | Marshall | ..... | A45D 24/22 132/110 |

(Continued)

FOREIGN PATENT DOCUMENTS

| | | | | |
|---|---|---|---|---|
| DE | 3615870 A1 * | 11/1987 | ..... | A45D 19/02 |
| FR | 1172458 A * | 2/1959 | ..... | A45D 24/22 |

OTHER PUBLICATIONS

English machine translation of Deutschland Publication No. DE 3615870 A1, dated Nov. 12, 1987.

(Continued)

*Primary Examiner* — Tatiana Nobrega

(57) ABSTRACT

A hair dye applicator includes an applicator base having a comb and a dam configured to capture hair dye for dispensing during application, and including a handle having a first section extending from the applicator base and a second section extending from the first section at an angle relative to the first section. The dam may further include a carrier material configured to capture the hair dye, and the second section of the handle may be tapered. A method of applying hair dye using the hair dye applicator includes loading hair dye onto the applicator dam at the carrier material, and applying hair dye to the hairline by inserting the comb of the applicator at a start of the hairline and running the applicator starting at the comb in a direction away from the start of the hairline toward the remainder of the hair to receive the hair dye.

8 Claims, 10 Drawing Sheets

(56) References Cited

U.S. PATENT DOCUMENTS

| | | | | | |
|---|---|---|---|---|---|
| 2,000,456 | A * | 5/1935 | Schifter | A45D 19/02 | 132/110 |
| 2,370,258 | A * | 2/1945 | Pyle | A45D 24/22 | 132/110 |
| 2,797,695 | A | 7/1957 | Fortmann | | |
| 2,817,343 | A | 12/1957 | Honig | | |
| 2,837,099 | A * | 6/1958 | Meer, Jr. | A45D 24/22 | 132/110 |
| 3,762,425 | A * | 10/1973 | Loeffler | A45D 24/30 | 132/110 |
| 3,861,407 | A * | 1/1975 | Gabriele | A45D 24/16 | 132/108 |
| 4,013,086 | A * | 3/1977 | Chmela | A45D 24/10 | 132/110 |
| 4,294,270 | A * | 10/1981 | Cochran | A45D 24/22 | 132/112 |
| 5,062,435 | A * | 11/1991 | Ohtsuka | A45D 19/02 | 132/108 |
| 5,325,878 | A * | 7/1994 | McKay | A45D 24/24 | 132/108 |
| 5,437,293 | A * | 8/1995 | Colon | A45D 19/02 | 132/120 |
| 5,533,537 | A * | 7/1996 | Mourad | A45D 19/02 | 132/113 |
| 2006/0076030 | A1* | 4/2006 | De Laforcade | A45D 19/02 | 132/142 |
| 2006/0283473 | A1* | 12/2006 | Chudzik | A45D 24/02 | 132/125 |
| 2008/0053475 | A2* | 3/2008 | Castagno | A45D 19/0008 | 132/320 |
| 2011/0315157 | A1* | 12/2011 | Mercier | A45D 19/02 | 132/112 |

OTHER PUBLICATIONS

Written Opinion for International Application No. PCT/US2014/061268, dated Feb. 6, 2015 (6 pgs.).

International Search Report for International Application No. PCT/US2014/061268, dated Feb. 6, 2015 (2 pgs.).

* cited by examiner

HAIR DYE APPLICATOR AND METHODS OF USE

CROSS-REFERENCE TO RELATED APPLICATIONS

This application claims priority to and the benefit of U.S. Provisional Patent Application No. 61/905,348, filed in the U.S. Patent and Trademark Office on Nov. 18, 2013, the entire content of which is incorporated herein by reference.

BACKGROUND

1. Field

Aspects of the present invention relate to a hair or other dye applicator and methods of applying the same, and more particularly, to a hair or other dye applicator preventing or minimizing contact of the dye with the skin or scalp during application, and related methods.

2. Description of the Related Art

Conventional applicators, brushes, and bottles for the application of dye to hair on the head, face, or other areas, generally have minimal to no control means for preventing the dye from coming into contact with the skin around or under the areas where the dye is applied. Often, users apply a coat of protectant cream or dye-resistant material, e.g., petroleum jelly, around the hairline where the dye will be applied prior to applying dye to the hair. Application of these dye-resistant materials can be messy, time consuming, tedious, costly, and ineffective, especially if improperly, hastily, or inaccurately applied. Moreover, areas adjacent to where dye may be applied, e.g., the scalp, may not be protected from contact with the dye, as applying dye-resistant material at these locations may be impractical and may also prevent the dye from properly coloring the hair.

Especially for in-home application of dye to the hair on the head, face, or other areas, users are more likely to miss spots or portions surrounding the hair line in the application of a dye-resistant material surrounding the hairline. Moreover, application of a dye-resistant material surrounding the entire hairline is a time consuming process, whether done at home by a user or in a salon by a professional, etc. Further, in order to prevent contact of the dye with the skin, users will often apply the dye less precisely than at the start of the root, where the dye application is generally desired, resulting in uneven coverage. For certain dye applications, time is of the essence, where the application may only require a few to several minutes before the dye should be washed out of the hair. In these particular types of applications, it is especially important to enable users to apply the dye quickly, efficiently, and evenly. Also, because salon dye treatments can be costly, many users opt to color and touch-up their roots at home. However, generally known dye applicators often result in a messy, tedious, time-consuming, and/or uneven application of color when used in-home by non-professionals and/or using conventional tools and methods.

SUMMARY

Aspects of the present invention relate to a hair or other dye applicator and methods of applying the same, and more particularly, to a hair or other dye applicator preventing or minimizing contact of the dye with the skin or scalp during application, and related methods.

According to aspects of the present invention, a hair dye applicator according to an embodiment includes an applicator base including a comb and a dam configured to capture hair dye for dispensing during application; and a handle having a first section extending from the applicator base and a second section extending from the first section at an angle relative to the first section. The dam may further include a shelf substantially parallel to the comb, a wall substantially perpendicular to the shelf, and a carrier material coupled to the wall and configured to capture the hair dye. The second section of the handle may be tapered.

In an embodiment, the comb may include teeth closely spaced apart and configured such that hair dye placed on the applicator base at the comb and dam remains fully contained on the applicator base prior to being dispensed during application.

In an embodiment, the comb may have a first length extending in a first direction along a bottom of the hair dye applicator, and the dam may have a first height extending from the comb in a second direction substantially parallel to the first direction. The applicator dam may be configured to be loaded with hair dye at a substantially triangular angle starting along the first length of the comb and over the shelf at the bottom of the hair dye applicator having a length less than or equal to the first length of the comb and tapering up to the top of the dam at the wall up to and having a height less than or equal to the first height. The applicator dam may be configured to dispense the loaded hair dye during application only to an intended surface through the hair dye applicator through the teeth of the comb.

In an embodiment, the first length of the comb may be at least ¼ inch, the first height of the dam may be at least ½ inch, the shelf of the dam may have a first width of at least 1⅜ inches, and the dam may have a first depth at the shelf that is less than or equal to the first length of the comb.

In an embodiment, the carrier material may include a fibrous material having a thickness of approximately 1/16 inch.

In an embodiment, the carrier material may further include a length corresponding to a first height of the dam of approximately ½ inch and a width corresponding to a width of the shelf of approximately 1⅜ inch.

In an embodiment, the carrier material may further include an adhesive material on an opposite surface from the fibrous material, the adhesive material being coupled to the applicator dam at the shelf In an embodiment, the carrier material may be removably coupled to the applicator dam.

In an embodiment, the comb may include 17 teeth closely spaced apart and configured such that hair dye placed on the applicator base at the comb and dam remains fully contained on the applicator base prior to being dispensed during application. Each of the 17 teeth may have a diameter of 1/16 inch and the span of the 17 closely spaced apart teeth may be 1 5/16 inches from a first tooth to a last tooth.

In an embodiment, the applicator base and handle may include a plastic material including Acrylonitrile Butadiene Styrene (ABS) plastic.

In an embodiment, the first section of the handle may extend a length of at least ½ inch from the applicator base at an angle of approximately 100 degrees relative to a back side of the wall of the dam, and the second section of the handle extends up a length of at least 4½ inches from the first section at an angle of approximately 30 degrees relative to the first section. The second section of the handle may be tapered from a width of approximately ½ inch at a point where the second section and the first section are coupled to a width of approximately ⅛ inch at the opposite end of the handle.

According to aspects of the present invention, a method of applying hair dye to a hairline according to an embodiment using or utilizing a hair dye applicator including an applicator base including a comb and a dam, and a handle having a first section extending from the applicator base and a second section extending from the first section at an angle relative to the first section, includes coupling a carrier material configured to capture hair dye to the dam of the applicator base. The method may further include loading hair dye onto the dam at a substantially triangular approximately 45 degree angle starting along a first length of the comb at a bottom of the hair dye applicator having a length less than or equal to the first length of the comb and tapering up to a top of the dam at a first height of the dam and having a height less than or equal to the first height of the dam. The method may further include applying hair dye to the hairline by inserting the comb of the hair dye applicator at a start of the hairline and running the hair dye applicator starting at the comb in a direction away from the start of, the hairline toward the remainder of the hair to receive the hair dye. The method may further include repeating the loading and applying of hair dye until the hairline has received hair dye as desired. The applicator dam may be configured to dispense the loaded hair dye during application only to an intended surface through the hair dye applicator through the comb. The comb may include teeth closely spaced apart and configured such that hair dye placed on the applicator base at the comb and dam remains fully contained on the applicator base prior to being dispensed during application.

In an embodiment, the first length of the comb may be at least ¼ inch, the first height of the dam may be at least ½ inch, the dam may have a first width of at least 1⅜ inches, and the dam may have a first depth that is less than or equal to the first length of the comb.

In an embodiment, the carrier material may include a fibrous material having a thickness of approximately 1/16 inch.

In an embodiment, the carrier material may further have a length corresponding to a first height of the dam of approximately ½ inch and may have a width corresponding to a first width of the dam of approximately 1⅜ inch.

In an embodiment, the carrier material may further include an adhesive material on an opposite surface from the fibrous material configured to couple the carrier material to the dam of the hair dye applicator.

In an embodiment, the comb may include 17 teeth closely spaced apart and configured such that hair dye placed on the applicator base at the comb and dam remains fully contained on the applicator base prior to being dispensed during application. Each of the 17 teeth may have a diameter of 1/16 inch and the span of the 17 closely spaced apart teeth may be 1 5/16 inches from a first tooth to a last tooth.

In an embodiment, the applicator base and handle may include a plastic material including Acrylonitrile Butadiene Styrene (ABS) plastic.

In an embodiment, the the first section of the handle may extend a length of at least ½ inch from the applicator base at an angle of approximately 100 degrees relative to a back side of the dam, and the second section of the handle may extend up a length of at least 4½ inches from the first section at an angle of approximately 30 degrees relative to the first section. The second section of the handle may be tapered from a width of approximately ½ inch at a point where the second section and the first section are coupled to a width of approximately ⅛ inch at the opposite end of the handle. The angle and taper of the handle may be configured to allow hair dye to be applied to the hairline and only to desired surfaces to receive the dye.

In an embodiment, the carrier material may be removably coupled to the applicator dam such that after applying hair dye to the hairline, the carrier material may be configured to be removed from the applicator.

BRIEF DESCRIPTION OF THE DRAWINGS

These and other features and advantages of embodiments of the present invention will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
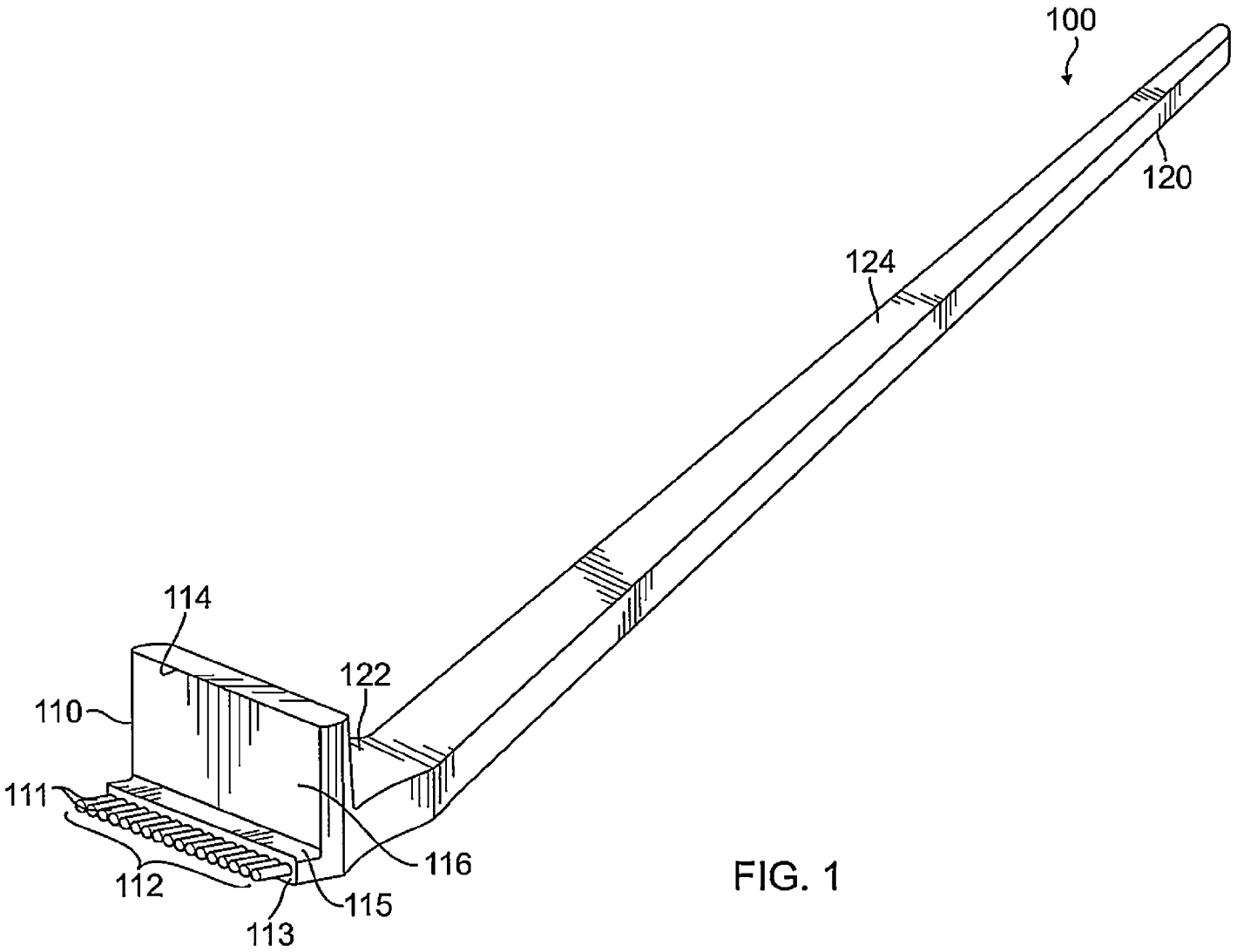
FIG. 1 is a perspective view of a hair dye applicator according to an embodiment of the present invention.

The detailed description set forth below in connection with the accompanying drawings is intended as a description of embodiments of a hair or other dye applicator preventing or minimizing contact of the dye with the skin or scalp during application, and related methods, as provided in accordance with the present invention, and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like reference numbers are intended to indicate like elements or features. Moreover, the sizes of the layers and regions in the drawings may be exaggerated for convenience of explanation.

With reference to FIG. 1, a perspective view of a hair dye applicator according to an embodiment of the present invention is shown. The hair dye applicator 100, according to this embodiment, includes an applicator base 110 including a comb 112 and a dam 114. The applicator base 110 may be configured to capture hair dye 160 (shown in FIGS. 9C-9D) for dispensing during application. The hair dye applicator 100, according to these embodiments, is configured to eliminate the stains or residue left behind, often along the hairline, for example on the forehead and the perimeter of the hair line or around the eyebrows, when hair dye or color is applied to the hair, hairline, eyebrows, or roots. This hair dye applicator 100 is further configured to be used for the application of dye or color 160 to any desired surface, including, for example, eyebrows and facial hair.

Figure 2:
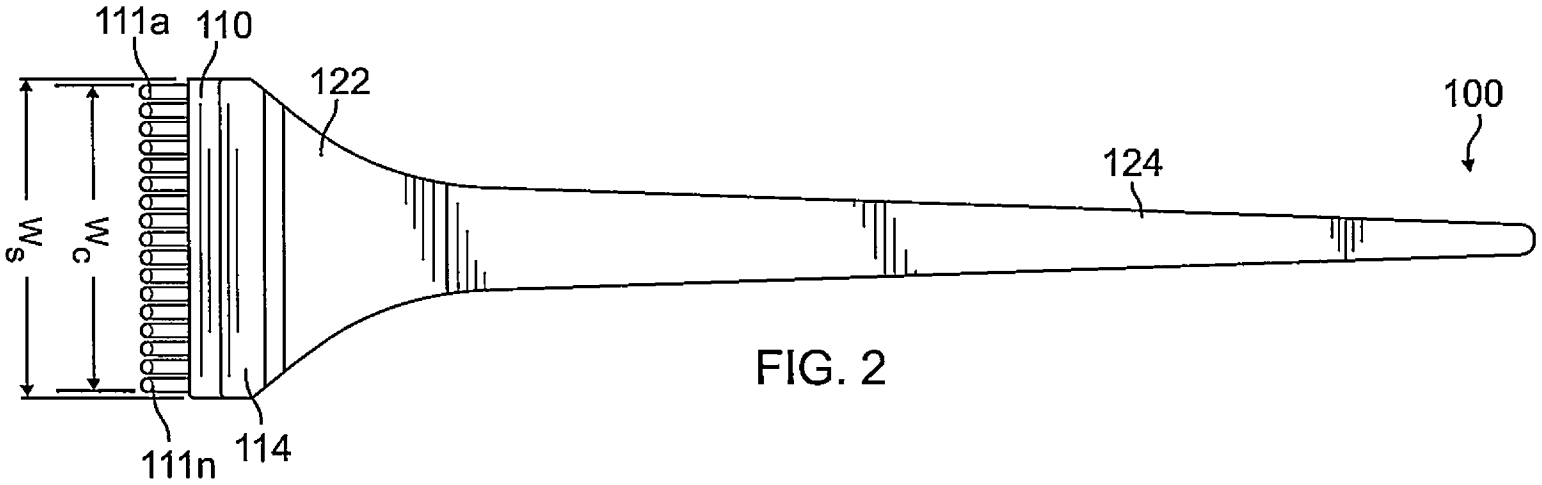
FIG. 2 is a top view of the hair dye applicator illustrated in FIG. 1.
Figure 3:
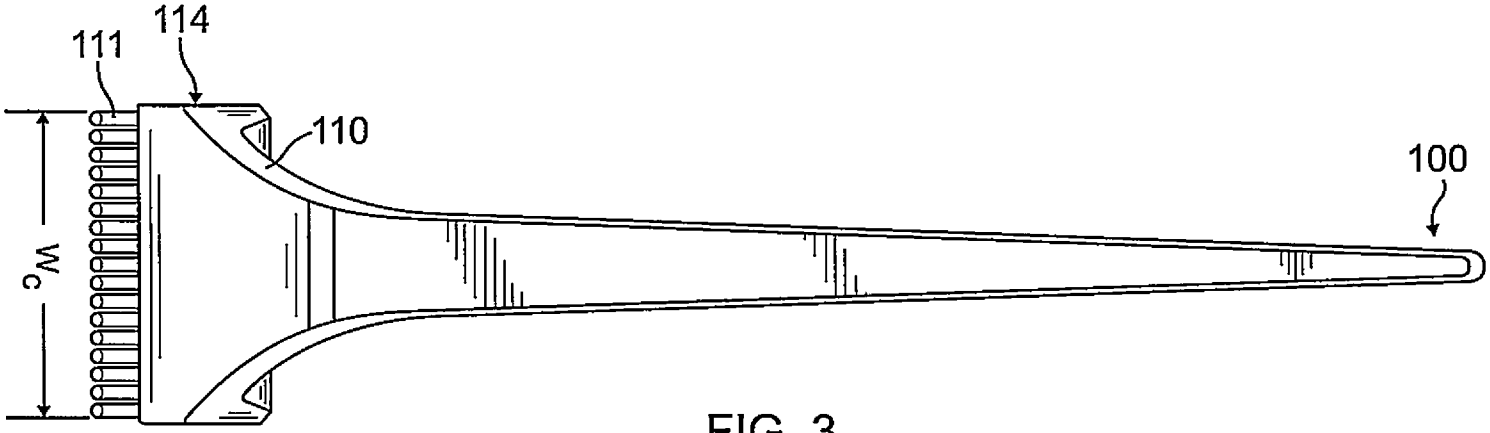
FIG. 3 is a bottom view of the hair dye applicator illustrated in FIG. 1.
Figure 4:
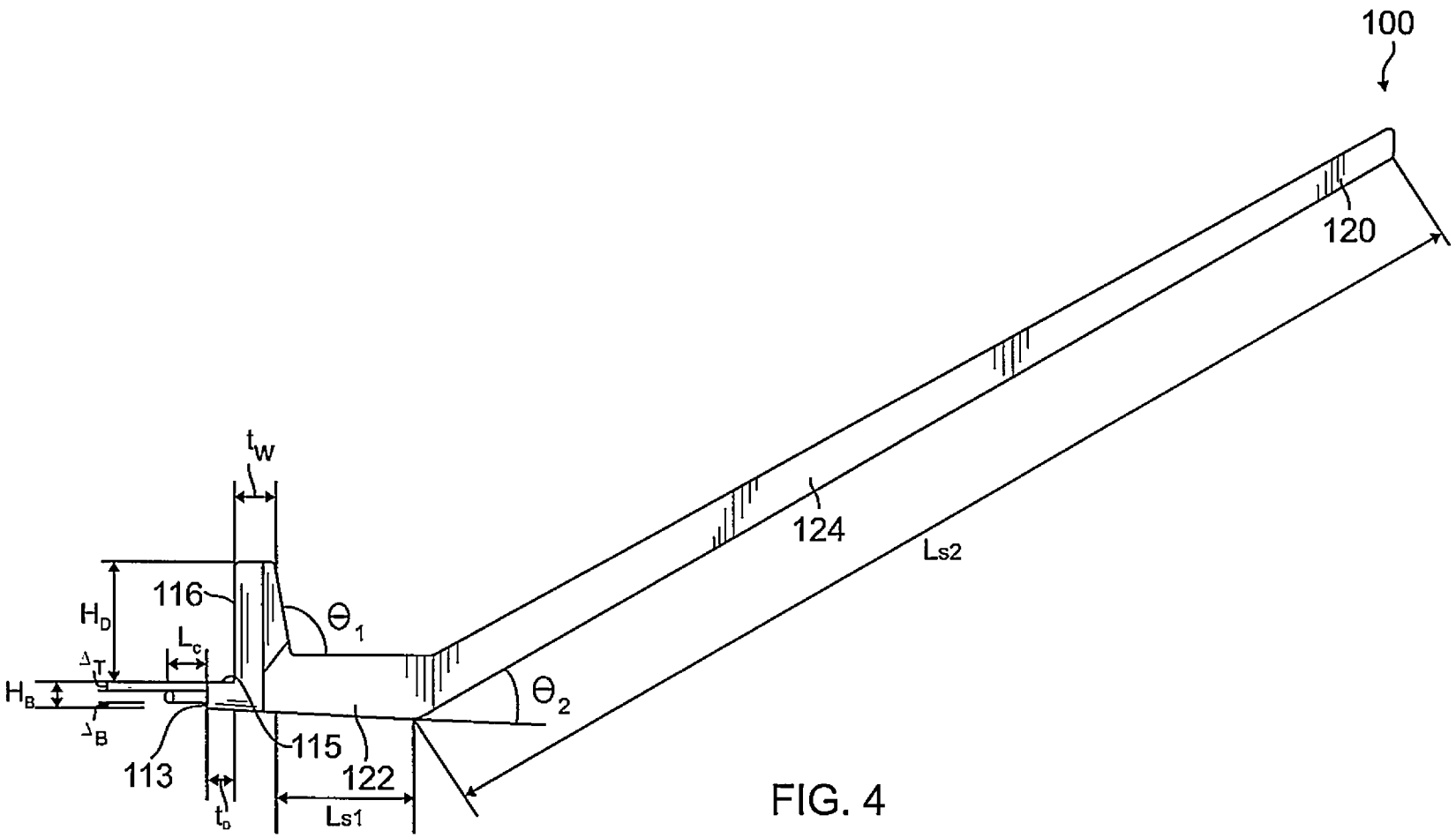
FIG. 4 is a side profile view of the hair dye applicator illustrated in FIG. 1.
Figure 5B:
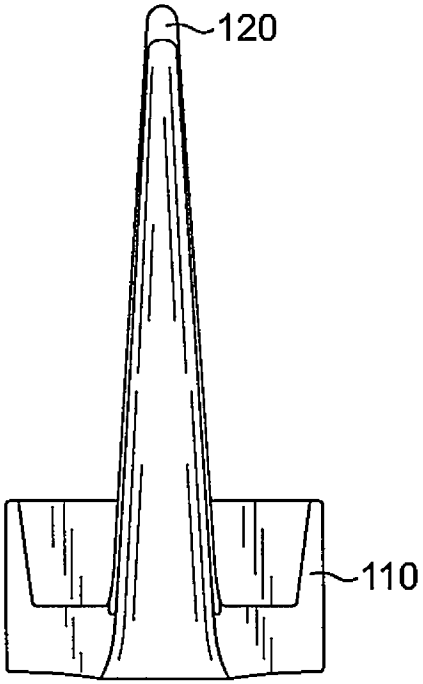
FIG. 5*b* is an elevation perspective taken from a back view of the applicator base of the hair dye applicator illustrated in FIG. 1.
Figure 5A:
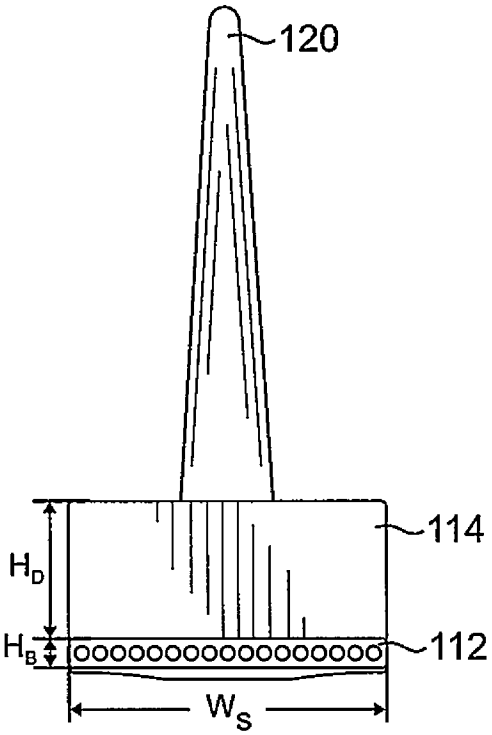
FIG. 5*a* is an elevation perspective taken from a front view of an applicator base of the hair dye applicator illustrated in FIG. 1.
Figure 6:
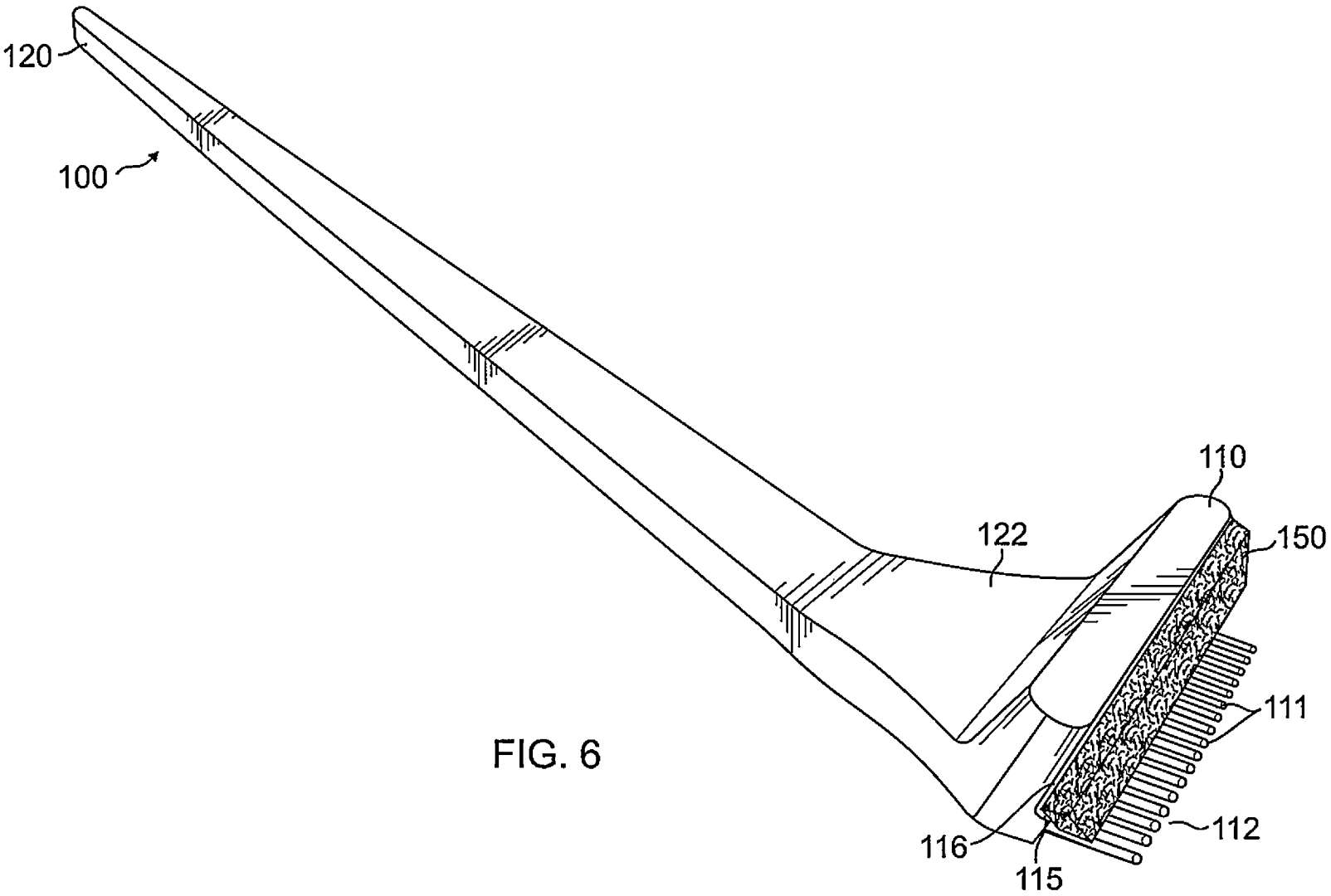
FIG. 6 is a partial perspective view of the applicator base of the hair dye applicator illustrated in FIG. 1, further illustrating a carrier material coupled to the applicator base according to an embodiment of the present invention.
Figure 7:
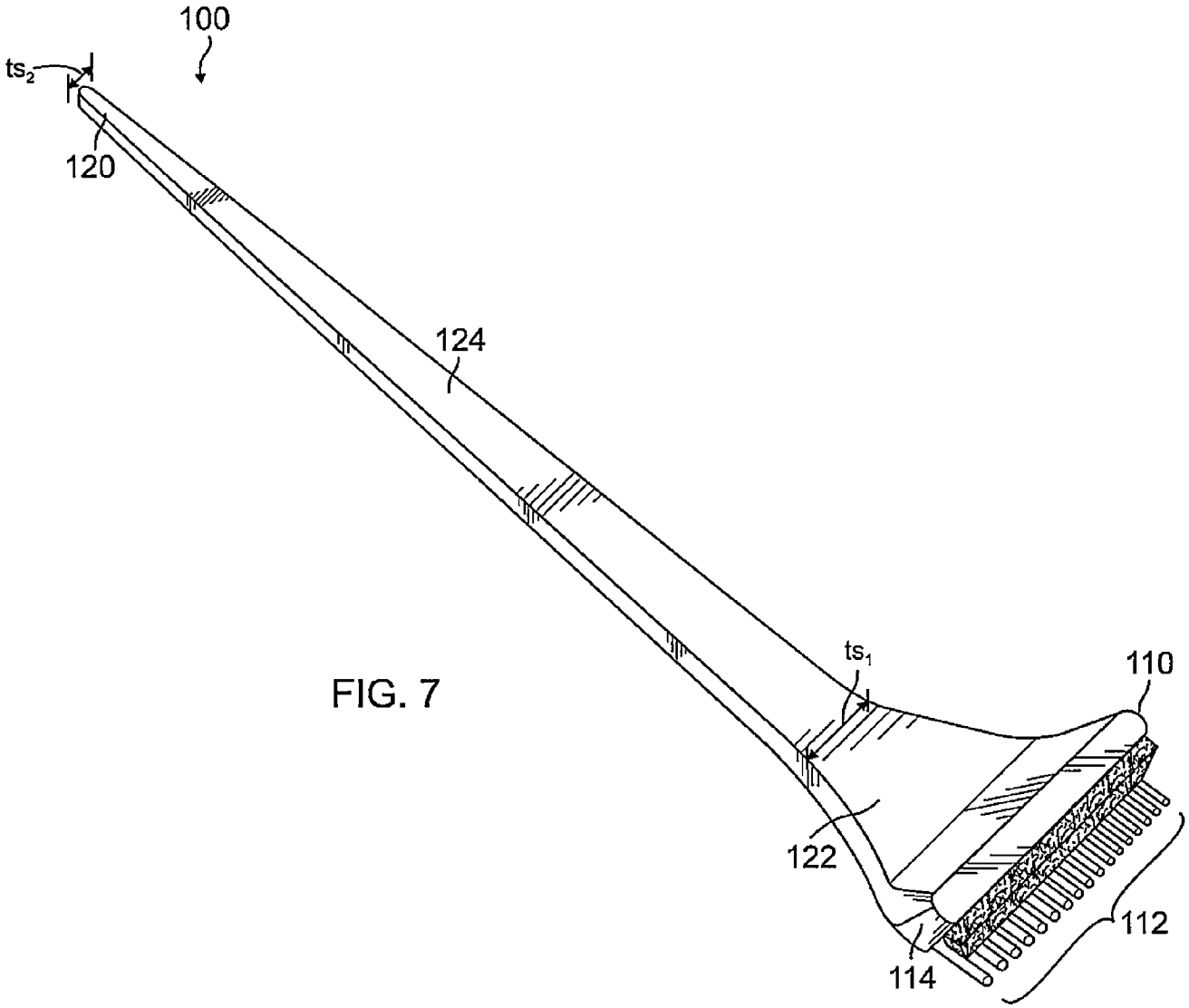
FIG. 7 is a perspective view of the hair dye applicator illustrated in FIG. 6 including the carrier material.

The comb 112 of the hair dye applicator 100, according to an embodiment, may further include teeth 111 closely spaced apart and configured such that hair dye 160 placed on the applicator base 110 at the comb 112 and dam 114 remains fully contained on the applicator base 110 prior to being dispensed during application. As shown in FIGS. 2, 3, and 4, each hair dye applicator 100 may include a plurality of teeth 111. As used herein and throughout this application, a plurality means more than two. In an embodiment, each hair dye applicator 100 includes 12-20 teeth 111. In one embodiment, the comb 112 of the hair dye applicator 100 includes 17 teeth 111 closely spaced apart and configured such that hair dye 160 placed on the applicator base 110 at the comb 112 and dam 114 remains fully contained on the applicator base 110 prior to being dispensed during application. In an embodiment, each of the teeth 110 has a diameter or thickness ranging from approximately ⅛ to approximately 1/32 inch. In an embodiment, each of the teeth 110 has a diameter or thickness of approximately 1/16 inch. A span or width $W_c$ of comb 112, according to an embodiment, may range from approximately 1¼ inches to approximately 2 inches. In an embodiment, the span or width $W_c$ of the comb 112 may be approximately 1 5/16 inches from a first tooth 111*a* to a last tooth 111*n* (shown in FIG. 2, for example). In an embodiment, the span or width $W_c$ of the comb 112 may range from approximately 1¼ inches to approximately 2 inches. In an embodiment, the width $W_c$ of the comb 112 may be approximately 1⅜ inches.

The comb 112 of the hair dye applicator 100, according to an embodiment, includes a length $L_C$ (also referred to herein as a first length of the comb 112) that ranges in length from approximately 1/16 to approximately ½ inch. In one embodiment, the length $L_C$ of the comb 112 is approximately ¼ inch. The teeth 111 of the comb 112, according to an embodiment, extend from the applicator base 110 at a housing 113 (as shown in FIGS. 1 and 4) having a height $H_B$ greater than the diameter of each tooth 111. According to an embodiment, a distance $\Delta_B$ from a bottom of the teeth 111 to the bottom of the housing 113 may range from approximately 1/32 inch to approximately ¼ inch and a distance $\Delta_T$ from a top of the teeth 111 to a top of the housing 113 may range from approximately 1/16 to approximately ½ inch. In one embodiment the distance $\Delta_B$ from the housing 113 to the bottom of the comb 111 is approximately 1/16 inch, and the distance $\Delta_T$ from the top of the teeth 111 to the top of the housing 113 is approximately ⅛ inch. In an embodiment, the teeth 111 of the comb 112 may taper or be angled from the housing 113 to the end of the comb 112, angling downward from the housing to the end of the comb 112.

With continued reference to FIG. 1 and with reference to FIGS. 2, 3, and 4, showing a top view, bottom view, and side profile view, respectively, of the hair dye applicator illustrated in FIG. 1, the dam 114 of the hair dye applicator 100 is described in further detail, according to embodiments of the present invention. The dam 114 may include a shelf 115 and a wall 116, the wall 116 extending from the shelf 115 in a direction substantially perpendicular to the shelf 115. The shelf 115, according to an embodiment, extends from the housing 113 of the comb 112. In an embodiment, the shelf 115 may include a depth $t_D$ ranging from approximately 1/32 inch to approximately ½ inch, and a height $H_b$ ranging from approximately ⅛ inch to approximately ⅜ inch. In one embodiment, the shelf 115 may include a depth $t_D$ of approximately 1/16 inch, and a height $H_b$ of approximately ¼ inch. The depth $t_D$ of the shelf 115 at the bottom of the dam 114 may also be referred to herein interchangeably as the first depth $t_D$ of the dam 114, and in an embodiment, may have a depth $t_D$ less than or equal to the first length $L_c$ of the comb 112.

In an embodiment, a width $W_c$ of the comb 112 is equal to a width $W_s$ of the shelf 115, which may range from approximately 1¼ inches to approximately 2 inches. In an embodiment, the width $W_s$ of the shelf 115 may be approximately 1⅜ inches. In an embodiment, the width $W_s$ of the shelf 115 may be approximately 1⅜ inches. In another embodiment, the width $W_c$ of the comb 112 may be equal to the width $W_s$ of the shelf 115, and may range from approximately ½ inch to approximately 1 inch. In an embodiment, the width $W_s$ of the shelf 115 may be approximately ⅝ inch. The wall 116, according to an embodiment, extends from the shelf 115. In an embodiment, the wall 116 may include a thickness $t_w$ extending in the same direction as the depth $t_D$ of the shelf 115 and ranging from approximately ⅛ inch to approximately ½ inch, and a height $H_D$ extending in a direction substantially parallel to the height $H_b$ of the shelf 115 and ranging from approximately ¼ inch to approximately 1 inch. In one embodiment, the wall 116 may include a thickness $t_w$ of approximately ¼ inch, and a height $H_D$ of approximately ½ inch. In an embodiment, the thickness $t_w$ of the wall 116 may taper from a bottom where the wall 116 extends from the shelf 115 to a top of the wall 116. In an embodiment, the wall 116 has a width equal to that of the width $W_s$ of the shelf.

The dam 114 of the hair dye applicator 100, according to an embodiment, may further include a carrier material 150 configured to capture the hair dye 160. The carrier material 150 may be coupled to the applicator base 110 at the dam 112. In an embodiment, the carrier material 150 may be coupled to the wall 116 of the dam 114. The carrier material 150, according to an embodiment, may include an adhesive-backed pad that is removably coupled to the applicator base 110. The adhesive-backing of the carrier material 150 may include a pressure sensitive adhesive material having a release liner. In other embodiments, the adhesive-backed pad of the carrier material 150 may be any suitable material recognized by those skilled in the art for removably coupling the carrier material 150 to the hair dye applicator 100, as described herein.

Figure 8:
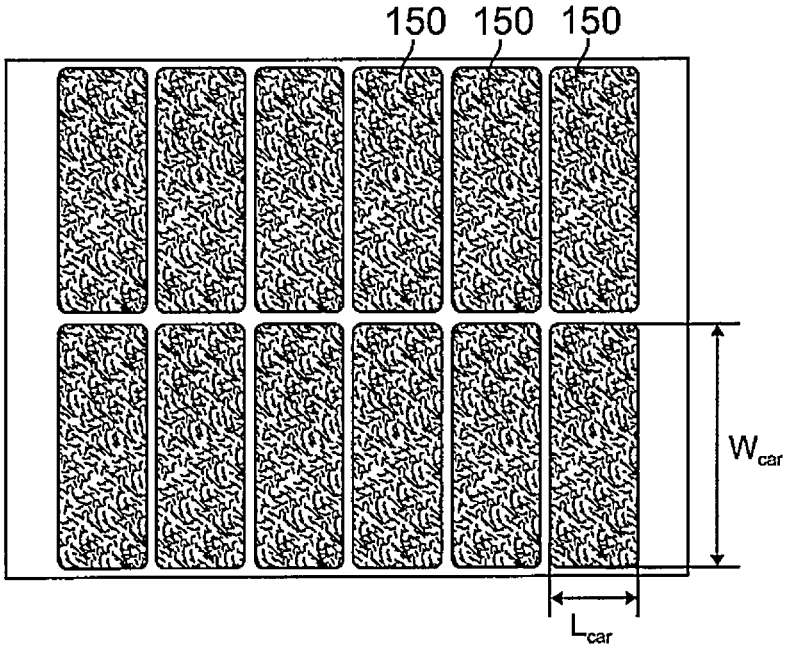
FIG. 8 is a top view of a sheet of carrier material, according to an embodiment of the present invention.
Figure 9A:
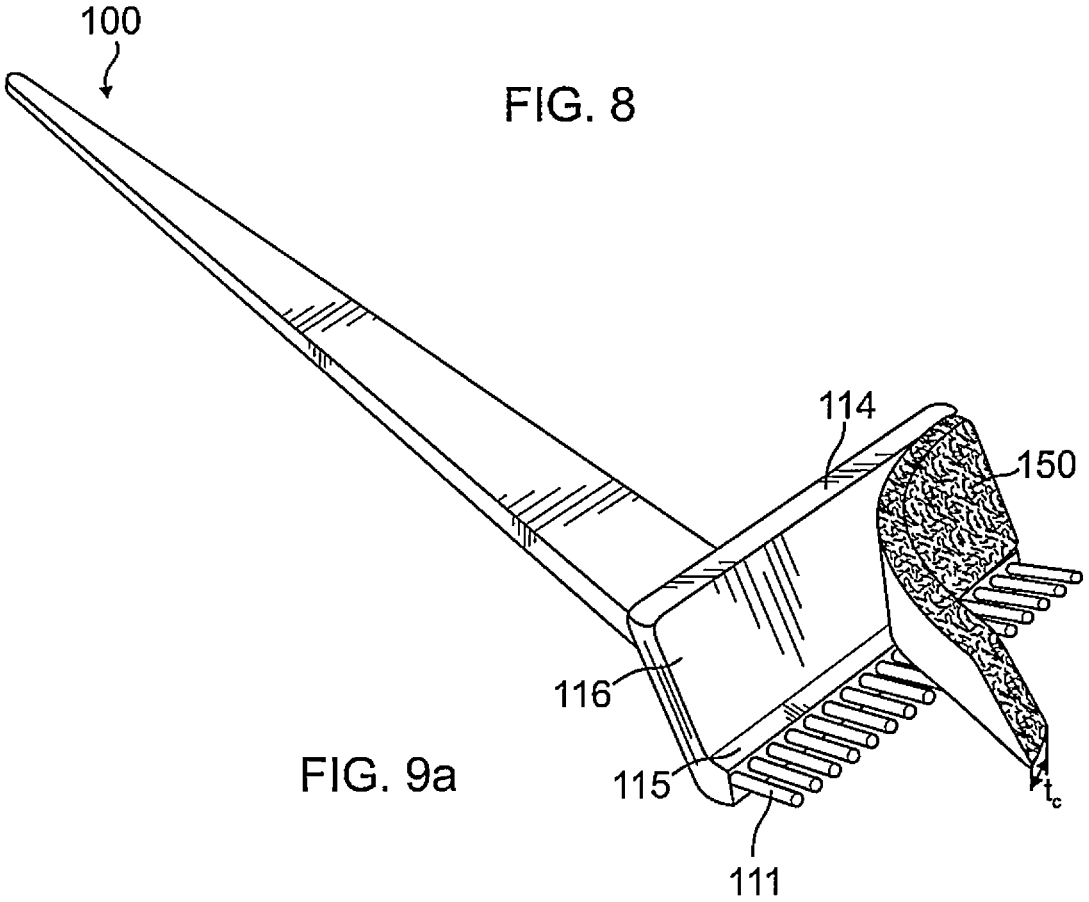
FIGS. 9*a*-9*g* illustrate a method of applying dye to the hairline using the hair dye applicator according to an embodiment of the present invention.
Figure 9B:
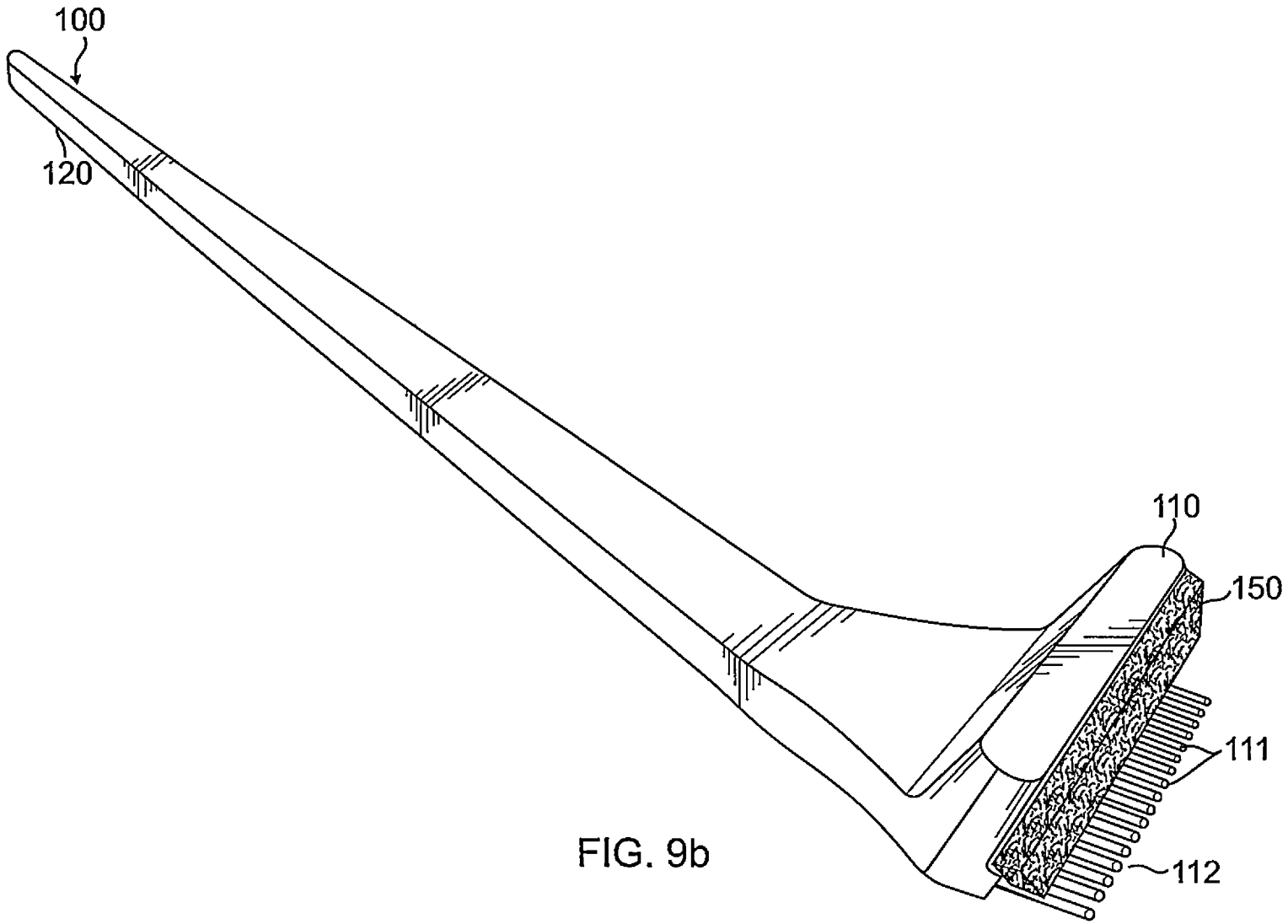

With continued reference to FIGS. 1-4 and with reference now to FIGS. 8 and 9*a*, the carrier material 150, according to an embodiment, may include a fibrous material. The fibrous material may include any material recognized by those skilled in the art, including hook and loop closure type materials or any course and/or loopy fabric capable of holding an amount of hair dye on the hair dye applicator 100. In other embodiments, the carrier material 150 may be any fibrous, course or medium course, and/or woven fabric configured to capture the hair dye 160. In an embodiment, the carrier material may have a thickness $t_C$ (as shown in FIG. 9*a*) ranging from approximately 1/32 inch to approximately ¼ inch. In one embodiment, the carrier material may have a thickness $t_C$ of approximately 1/16 inch. The carrier material 150 may further include a length $L_{car}$ corresponding to a height $H_D$ of the wall 116 of the dam 114 or otherwise interchangeably referred to herein as a first height $H_D$ of the dam 150, and a width $W_{car}$ corresponding to a width $W_s$ of the shelf 115 of the dam 114 or otherwise interchangeably referred to herein as a first width $W_s$ of the dam 114. In an embodiment, the carrier material 150 may have a length $L_{car}$ ranging from approximately ¼ inch to approximately 1 inch, and in an embodiment may be approximately ½ inch. In another embodiment, the carrier material 150 may have a width $W_{car}$ ranging from approximately 1 inch to approximately 2 inches, and in an embodiment, may be approximately 1⅜ inches.

With continued reference to FIGS. 1-4 and with reference now to FIGS. 5*a*, 5*b*, 6, and 7, the hair dye applicator 100, according to an embodiment, may further include a handle 120 having a first section 122 extending from the applicator base 110 and a second section 124 extending from the first section 122. The first section 122 may extend at an angle $\theta_1$ relative to the applicator base 110. The angle $\theta_1$ relative to the wall 116 of the applicator base 110, according to an embodiment, may range from approximately 90 degrees to approximately 120 degrees. In an embodiment, the angle $\theta_1$ may be approximately 100 degrees relative to base 110 (as shown in FIG. 4, for example). The second section 124 may extend at an angle $\theta_2$ relative to the first section 122. The angle $\theta_2$ relative to the first section 122, according to an embodiment, may range from approximately 20 degrees to approximately 45 degrees. In an embodiment, the angle $\theta_2$ may be approximately 30 degrees relative to the first section 122 (as shown in FIG. 4, for example).

With continued reference to FIGS. 1-7, the first section 122 of the handle 120 extends a length $L_{s1}$ from the applicator base 110 (as shown in FIG. 4). In an embodiment, the length $L_{s1}$ of the first section 122 (measured from a bottom side of the applicator 100) ranges from approximately ¼ inch to approximately 1 inch. In one embodiment, the length $L_{s1}$ of the first section 122 is at least ½ inch from the applicator base 110 at an angle $\theta_1$ of approximately 100 degrees relative to the dam 114. The second section 124 of the handle 120 extends a length $L_{s2}$ from the first section 122 (as shown in FIG. 4). In an embodiment, the length $L_{s2}$ of the second section 124 (measured from a bottom side of the applicator 100) ranges from approximately 3½ inches to approximately 6 inches. In one embodiment, the length $L_{s2}$ of the second section 124 is at least 4½ inches from the first section 122 at an angle $\theta_2$ of approximately 30 degrees relative to the first section 122. In an embodiment, the second section 124 of the handle 120 is tapered. In an embodiment, the second section 124 of the handle 120 may be tapered from a first width $t_{s1}$ at the point where the first section 122 and the second section 124 are coupled to a second width $t_{s2}$ at the opposite end of the handle 120 (at a tip). In one embodiment, the first width $t_{s2}$ at the point where the first section 122 and the second section 124 are coupled has a width ranging from approximately ¼ inch to approximately 1½ inch, and the second width $t_{s2}$ at the opposite end of the handle 120 has a width ranging from approximately 1/32 inch to approximately ½ inch. In one embodiment, the first width $t_{s1}$ is approximately ½ inch, and the second width $t_{s2}$ is approximately ⅛ inch at the opposite end of the handle 120.

With continued reference to FIGS. 1-7, the hair dye applicator 100, according to an embodiment, may be made of a material sufficiently stiff to support rigorous use and reuse, while also being resistant to staining from use with dyes. In an embodiment, the hair dye applicator 100 may be made from a plastic material, for example, including Acrylonitrile Butadiene Styrene (ABS) plastic. In another embodiment, the hair dye applicator 100 may be made from a metal or metallic material. In other embodiments, the hair dye applicator 100 may be made from any hard plastic material or hard plastic injection molded unit generally known and appreciated by those skilled in the art for application of hair dye. In an embodiment, the applicator handle 120, the applicator base 110, and the applicator comb 112 may be made of different materials. In other embodiments, the applicator handle 120, the applicator base 110, and the applicator comb 112 may be made of the same materials. In one embodiment, the applicator base 110 and handle 120 are made of a plastic material, for example, Acrylonitrile Butadiene Styrene (ABS) plastic. In some embodiments, the applicator handle 120, the applicator base 110, and the applicator comb 112 may be made of the same materials and integrally formed.

With continued reference to FIGS. 1-4 and with reference now to FIGS. 9*a*-9*g*, illustrating a method of applying dye 160 to the hairline, the hair dye applicator 100 according to embodiments of the present invention is further described below. In these embodiments, like reference numerals denote like parts and repeated descriptions have been omitted. Moreover, the applicator 100, as described above, may be substantially similar to an applicator 100 used for application of the dye 160 to the hair. Accordingly additional descriptions of embodiments of the apparatus have been omitted.

In an embodiment, a method of applying hair dye 160 to the hairline using the hair dye applicator 100 (for example, as described above), includes the task of coupling the carrier material 150 to the applicator 100. In this embodiment, the carrier material 150 may be coupled to the applicator 100 by removing the carrier material 150 from the sheet containing a plurality of carrier material 150 segments (for example, as shown in FIG. 8), or by removing an individual carrier material 150 sheet for use with the applicator 100. The carrier material 150, in this embodiment, may be removably coupled to the applicator 100 by removing the release liner or backing to expose an adhesive. In other embodiments, the carrier material 150 may not include an adhesive backing and may be removably coupled to the applicator 100 using other materials and/or methods known in the art. The task of removably coupling the carrier material 150 to the applicator 100 may include coupling or attaching the carrier material 150 to the wall 116 of the dam 114 at the applicator base 110. In this embodiment, the carrier material 150 may be sized substantially similarly to the size of the wall 116 of the applicator base 110 such that carrier material 150 covers the entire surface of the wall 116. In other embodiments, the carrier material 150 may be sized to be approximately the same or smaller than the size of the wall 116 of the applicator base 110. In other embodiments, the carrier material 150 may be sized to be approximately the same or larger than the size of the wall 116 of the applicator base 110. The carrier material 150, in these embodiments, is configured to capture the hair dye 160 at the dam 114 of the applicator 100 (as described in further detail below).

Figure 9D:
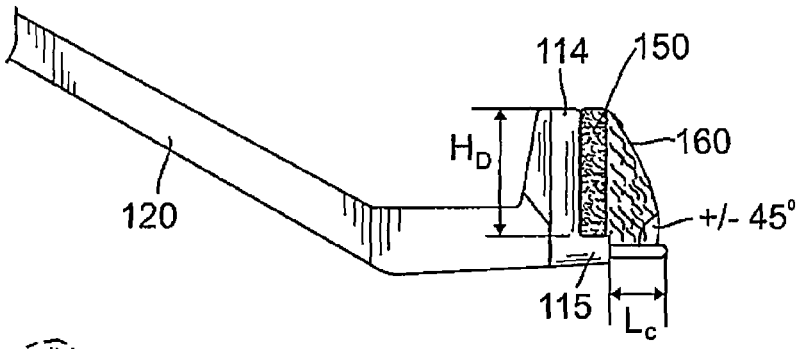
Figure 9C:
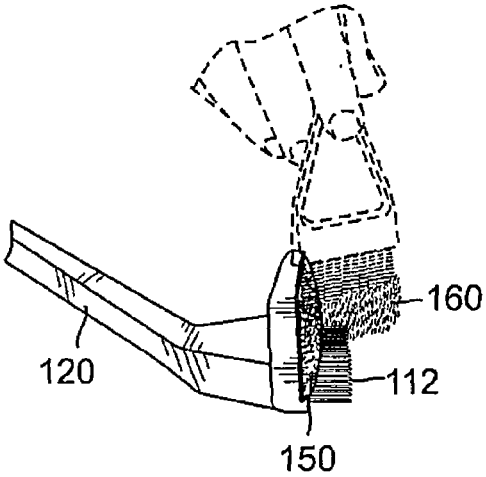
Figure 9E:
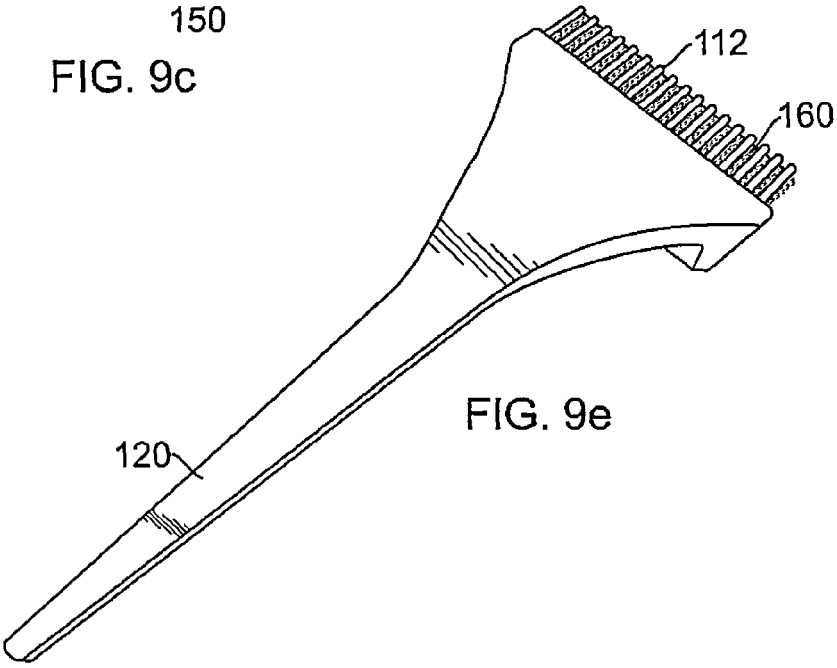
Figure 9F:
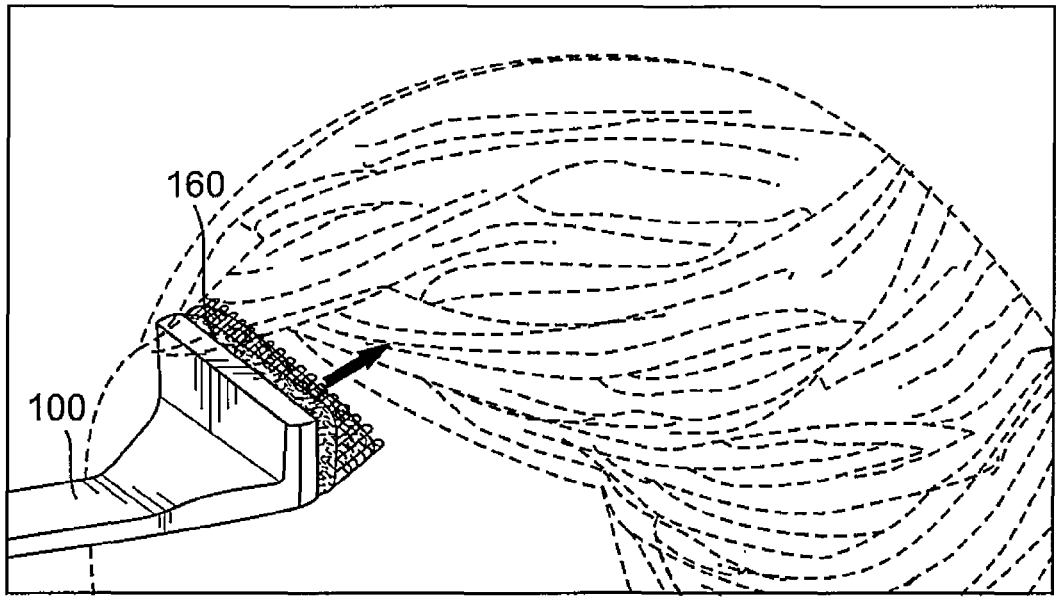
Figure 9G:
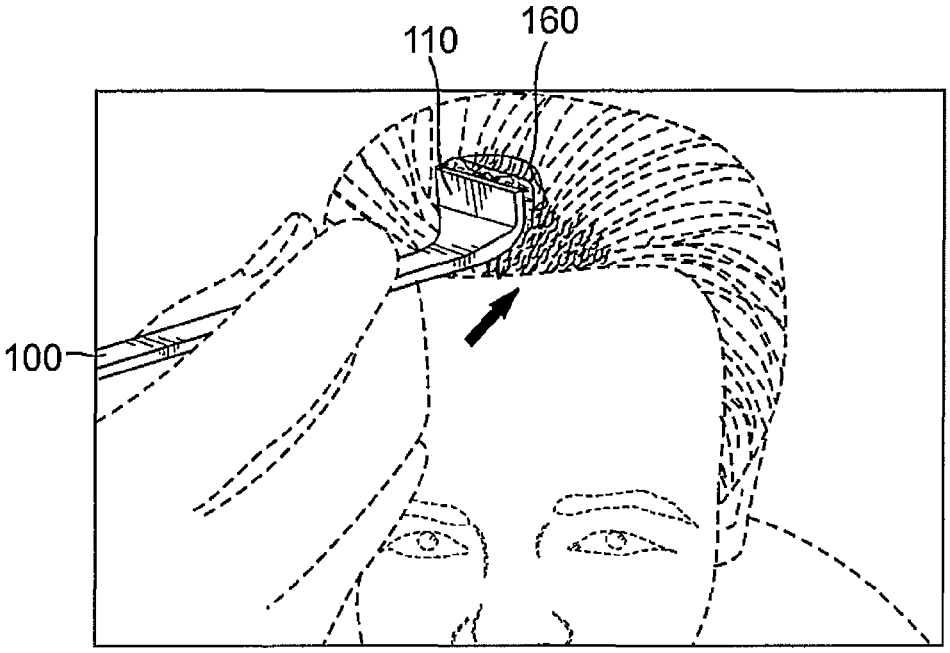

In an embodiment, the method of applying hair dye 160 to the hairline using the hair dye applicator 100 further includes the task of loading hair dye 160 onto the hair dye applicator 100 at the dam 114. In this embodiment, the applicator dam 114, along with the carrier material 150, is configured to be loaded with hair dye 160 at a substantially triangular angle starting along the first length $L_c$ of the comb 112 at the bottom of the hair dye applicator 100 over the teeth 111. The triangular shape of the dye 160 applied to the applicator 100 in this embodiment may have a length (or bottom leg) less than or equal to the first length $L_C$ of the comb 112 and tapering up to the top of the dam 114 at the first height $H_D$ (or the second leg of the triangular shape) and having a height less than or equal to the first height $H_D$ (as shown in FIGS. 9*c*-9*e*). In this embodiment, the applicator dam 114 may be configured to dispense the loaded hair dye 160 during application only to an intended surface through the hair dye applicator 100 through the teeth 111 of the comb 112. In an embodiment, the hair dye 160 loaded onto the applicator 100 may be loaded at an angle ranging from approximately 30 degrees to approximately 60 degrees. In one embodiment, the hair dye 160 is loaded onto the hair dye applicator 100 at a 45 degree angle starting from the comb 112 and up to the top of the wall 116 of the applicator base 114. In other embodiments, the hair dye 160 may be loaded onto the hair dye applicator 100 using other means and methods, including in shapes other than a substantially triangular shape. In an embodiment, the hair dye 160 is loaded onto the hair dye applicator 100 using any conventional means known in the art, including, for example, use of a dye brush, an applicator bottle, or any other means suitable for loading the hair dye applicator 100 with hair dye 160. During the of loading of hair dye 160 onto the hair dye applicator 100, the hair dye applicator 100 is configured to be loaded from the top of the applicator 100 such that the bottom surface of the teeth 111 of the comb 112 remain clean and without dye 160. The dye 160 for application to the hair dye applicator 100, according to some embodiments, may be in a paste or thickened/viscous form to further aid in it remaining fully contained or dammed on the applicator base 110 prior to being dispensed during application.

The method of applying hair dye 160 to the hairline using the hair dye applicator 100, according to an embodiment, further includes the task of applying hair dye 160 to the hairline by inserting the comb 112 of the hair dye applicator 100 at a start of the hairline and running the hair dye applicator 100 starting at the comb 112 in a direction away from the start of the hairline toward the remainder of the hair to receive the hair dye 160. The comb 112 according to this embodiment may be inserted through the hair using the teeth 111, each configured to enter and be run through the hair or hairline of the recipient. The teeth 111 of the comb 112, as described above, are closely spaced apart and configured such that hair dye 160 placed on the applicator base 110 at the comb 112 and dam 114 remains fully contained or dammed on the applicator base 110 prior to being dispensed during application, and only releasing upon application of the comb 112 through the hair or hairline of the recipient. FIG. 9*e* illustrates the hair dye applicator 100 as shown from a bottom view with the hair dye 160 contained on the comb 112 between the teeth 111 after loading. Thus, the applicator dam 114, according to these embodiments, is configured to dispense the loaded hair dye 160 during application only to an intended surface through the hair dye applicator 100 through the teeth 111 of the comb 112. The task of applying hair dye 160 to the hairline, according to these embodiments, may include resting the loaded hair dye applicator 100 at the bottom of its base 110 on the surface surrounding the hair or hairline to receive the dye 160, for example, on the forehead of the recipient, and pushing the applicator 100 through the hair or hairline a distance approximately ½ inch in from its perimeter (as indicated by the arrows in FIGS. 9*f* and 9*g*). The task of applying hair dye 160 to the hairline, according to these embodiments may include continuing or repeating the task by resting loaded hair dye applicator 100 at the bottom of its base 110 on the surface surrounding the hair or hairline and pushing the applicator 100 through the hair or hairline a distance ranging from approximately ½ inch to ¾ inch in from its perimeter at the next adjacent or neighboring segment of the hair or hairline until all of the desired area has received dye 160. The remainder of the hair or hairline away from the perimeter may be dyed using the hair dye applicator 100 or other means, methods, and apparatuses for applying dye 160 known in the art.

The task of applying hair dye 160, according to another embodiment, may include inserting the comb 112 of the hair dye applicator 100 at a start of the eyebrow, for example, at the one end of the eyebrow closest to the nose, and running the hair dye applicator 100 starting at the comb 112 in a direction away from the start of the eyebrow along the eyebrow toward the remainder of the eyebrow hair to receive the hair dye 160. The comb 112 according to this embodiment may be inserted through the eyebrow hair using the teeth 111, each configured to enter and be run through the hair of the eyebrow of the recipient. The teeth 111 of the comb 112, as described above, are closely spaced apart and configured such that hair dye 160 placed on the applicator base 110 at the comb 112 and dam 114 remains fully contained or dammed on the applicator base 110 prior to being dispensed during application, and only releasing upon application of the comb 112 through the hair of the eyebrow of the recipient. The task of applying hair dye 160, according to these embodiments, may include resting the loaded hair dye applicator 100 at the bottom of its base 110 on the surface surrounding the eyebrow to receive the dye 160, for example, on the nose-bridge of the recipient, and pushing the applicator 100 through the hair of the eyebrow along the shape of the eyebrow. The task of applying hair dye 160 to the eyebrow, according to these embodiments may include continuing or repeating the task by resting the loaded hair dye applicator 100 at the bottom of its base 110 on the surface surrounding the eyebrow (e.g., the facing the opposite eyebrow) and pushing the applicator 100 through the hair of the eyebrow along the shape of the eyebrow.

The task of applying hair dye 160 to the hairline by inserting the comb 112 of the hair dye applicator 100 at a start of the hairline, according to another embodiment, may include inserting the comb 112 of the hair dye applicator 100 at a start of facial hair including a beard or a moustache, or other facial hair, of the recipient, for example, at the one end of the face along the sideburns or at a center of a moustache above centerline of the lips, and running the hair dye applicator 100 starting at the comb 112 in a direction away from the starting point along the beard or moustache toward the remainder of the beard or moustache hair to receive the hair dye 160. The comb 112 according to this embodiment may be inserted through the beard or moustache hair using the teeth 111, each configured to enter and be run through the hair of the beard or moustache of the recipient. The teeth 111 of the comb 112, as described above, are closely spaced apart and configured such that hair dye 160 placed on the applicator base 110 at the comb 112 and dam 114 remains fully contained or dammed on the applicator base 110 prior to being dispensed during application, and only releasing upon application of the comb 112 through the hair of the beard or moustache of the recipient. The task of applying hair dye 160 to the facial hair, according to these embodiments, may include resting the loaded hair dye applicator 100 at the bottom of its base 110 on the surface surrounding the part of the face to receive the dye 160, for example, above the sideburn or lips of the recipient, and pushing the applicator 100 through the hair of the beard or moustache along the shape of the beard or moustache. The task of applying hair dye 160 to the beard or moustache, according to these embodiments may include continuing or repeating the task by resting the loaded hair dye applicator 100 at the bottom of its base 110 on the surface surrounding the facial hair (e.g., the facing the opposite sideburn or side of the moustache) and pushing the applicator 100 through the facial hair along the shape of the beard or moustache.

The hair dye applicator 100, according to these embodiments and as described above, includes a first section 122 of the handle 120 that extends a length $L_{s1}$ from the applicator base 110 at an angle $\theta_1$ relative to the dam 110, and the second section 124 of the handle 120 extends a length $L_{s2}$ from the first section at an angle $\theta_2$ relative to the first section 122. The second section 124 of the handle 120, in this embodiment, is tapered from a first width $t_{s1}$ at a point where the second section 124 and the first section 122 are coupled to a second width $t_{s2}$ at the opposite end of the handle 120. The angles $\theta_1$ and $\theta_2$ and taper of the handle 120, in these embodiments, are configured to allow the hair dye 160 to be applied to the hairline and only to the desired surfaces to receive the dye 160. The lengths $L_{s1}$ and $L_{s2}$, angles $\theta_1$ and $\theta_2$, and taper of the handle 120, allow for an ergonomic grip and use for a user during the tasks of loading and applying hair dye 160 to the hairline, as desired The method of applying hair dye 160 to the hairline using the hair dye applicator 100, according to an embodiment, further includes the task of repeating the tasks of loading and applying hair dye 160 until the hairline has received hair dye 160 as desired. Once the hairline has received hair dye 160 as desired, the carrier material 150 may be removed or released from the hair dye applicator 100 and disposed of. The hair dye applicator 100 may be washed and/or cleaned for future use with a new carrier material 150. In some embodiments, the carrier material may include a reusable or washable carrier material 150.

The hair dye applicator 100, according to the embodiments described in this application, may be used or utilized by home users, salon professionals, or others to apply dye 160 to the hairline while minimizing or preventing the dye 160 from getting on the surrounding areas, including the ears, back of neck, and forehead, for-example. The hair dye applicator 100, according to these embodiments, may be used or utilized to apply dye 160 to areas including the hairline surrounding the scalp, eyebrows, facial hair, etc.

While this invention has been described in detail with particular references to embodiments, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," "vertical," "horizontal," "top," "bottom," "middle," and similar have been used herein to describe a spatial relationship of one element to another, it should be understood that these terms are intended to encompass different orientations of the various elements and components of the invention in addition to the orientation depicted in the figures. Additionally, as used herein, the term "substantially," "about," "approximately," and similar are used as terms of approximation and not as terms of degree, and are intended to account for the inherent deviations in measured or calculated values that would be recognized by those of ordinary skill in the art. Moreover, the tasks described above may be performed in the order described or in any other suitable sequence. Instead, for each embodiment, one or more of the tasks described above may be absent and/or additional tasks may be performed. Furthermore, as used herein, when a component is referred to as being "on" another component, it can be directly or indirectly on the other component, meaning, for example, intervening layers, regions, or components may also be present. Moreover, when a component is referred to as being "coupled" to another component, it can be directly attached or connected to the other component, or other intervening components may also be present therebetween.

While the invention has been described in connection with certain embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A hair dye applicator comprising:

an applicator base comprising a comb and a dam configured to capture hair dye for dispensing during application, wherein the comb includes a plurality of parallel comb teeth forming a distal-most portion of the applicator base and the dam comprises a shelf and a wall extending substantially perpendicular to the shelf, the shelf being disposed between the comb and a front surface of the wall and including a top surface directly adjacent the wall, a front surface substantially perpendicular to the top surface forming a support from which the comb teeth extend perpendicularly, a bottom surface opposite the top surface and opposing lateral side surfaces defining the width of the shelf ($W_S$), the top surface of the shelf defining a death ($t_D$) of the dam between the front surface of the shelf and the front surface of the wall where the depth ($t_D$) of the dam is between approximately 1/32 inch and approximately 1/2 inch, and the wall having a width corresponding to the width of the shelf and a height defining the height ($H_D$) of the dam between the top surface of the shelf and a free, top surface of the wall;

a handle comprising a first section extending from the shelf and the wall in a proximal direction away from the applicator base and a second section extending from the first section at an angle ($\theta_2$) relative to the first section; and a carrier material having opposing front and back surfaces separated by a thickness where the back surface of the carrier is removably coupled to the front surface of the wall and the carrier is made of a fabric or fibrous material configured to capture the hair dye, the carrier having a length and width which are approximately equal to or less than the height and width of the wall, respectively and the thickness of the carrier is between approximately 1/32 inch and approximately 1/4 inch.

2. The hair dye applicator of claim 1, wherein the comb has a length ($L_C$) defined as the distance between the front surface of the shelf and distal free ends of the comb teeth, where the length of the comb ($L_C$) is approximately 1/4 inch, the height ($H_D$) of the dam is approximately 1/2 inch, the width of the shelf ($W_S$) is approximately 1 3/8 inches, and the depth ($t_D$) of the dam is less than or equal to the length of the comb ($L_C$).

3. The hair dye applicator of claim 1, wherein the thickness of the carrier material approximately 1/16 inch.

4. The hair dye applicator of claim 3, wherein the length of the carrier material is approximately ½ inch and the width of the carrier material is approximately 1⅜ inch.

5. The hair dye applicator of claim 3, wherein the carrier material further comprises an adhesive material on the back surface, the adhesive material being coupled to the front surface of the wall.

6. The hair dye applicator of claim 1, wherein the plurality of comb teeth comprise 17 teeth closely spaced apart and configured such that hair dye placed on the applicator base at the comb and dam remains fully contained on the applicator base prior to being dispensed during application, and each of the 17 teeth has a diameter of 1/16 inch and the span of the 17 closely spaced apart teeth is 1 5/16 inches from a first tooth to a last tooth.

7. The hair dye applicator of claim 1, wherein the applicator base and handle comprise a plastic material comprising Acrylonitrile Butadien Styrene plastic.

8. The hair dye applicator of claim 1, wherein the first section of the handle extends a length of at least ½ inch from the applicator base at an angle of approximately 100 degrees relative to a back side of the wall of the dam opposite the carrier material, and the second section of the handle has a length of at least 4½ inches and the angle ($\theta_2$ ) of extension of the second section is approximately 30 degrees relative to the first section; and the second section of the handle tapers from a width of approximately ½ inch at a point where the second section and the first section are coupled to a width of approximately ⅛ inch at the opposite end of the handle.

* * * * *